US012751496B2

(12) United States Patent
Cali et al.

(10) Patent No.: US 12,751,496 B2
(45) Date of Patent: Oct. 6, 2026

(54) AIR PRESSURE MEASUREMENT TO DETECT AN OBSTRUCTION IN AN AIRFLOW PATH

(71) Applicant: PHILIP MORRIS PRODUCTS S.A., Neuchatel (CH)

(72) Inventors: Ricardo Cali, Mannheim (DE); Wanjiang Han, La Tène (CH)

(73) Assignee: Philip Morris Products S.A., Neuchatel (CH)

( * ) Notice: Subject to any disclaimer, the term of this patent is extended or adjusted under 35 U.S.C. 154(b) by 429 days.

(21) Appl. No.: 18/578,458

(22) PCT Filed: Jul. 13, 2022

(86) PCT No.: PCT/EP2022/069642
§ 371 (c)(1),
(2) Date: Jan. 11, 2024

(87) PCT Pub. No.: WO2023/285554
PCT Pub. Date: Jan. 19, 2023

(65) Prior Publication Data

US 2024/0306727 A1 Sep. 19, 2024

(30) Foreign Application Priority Data

Jul. 14, 2021 (EP) ..... 21185651

(51) Int. Cl.
*A24F 47/00* (2020.01)
*A24F 40/10* (2020.01)
(Continued)

(52) U.S. Cl.
CPC ..... *A24F 40/53* (2020.01); *A24F 40/10* (2020.01); *A24F 40/44* (2020.01); *A24F 40/51* (2020.01); *A24F 40/57* (2020.01); *A24F 40/85* (2020.01)

(58) Field of Classification Search
CPC ..... A24F 40/50; A24F 40/51; A24F 40/53
See application file for complete search history.

(56) References Cited

U.S. PATENT DOCUMENTS 11,918,737 B2 3/2024 Lord
2015/0274457 A1 10/2015 Yamaguchi
(Continued)

FOREIGN PATENT DOCUMENTS

CN 112 006 338 12/2020
EP 3 372 098 9/2018
(Continued)

OTHER PUBLICATIONS

Extended European Search Report dated Feb. 9, 2022 (9 pages).
(Continued)

*Primary Examiner* — Eric Yaary
(74) *Attorney, Agent, or Firm* — Mueting Raasch Group

(57) ABSTRACT

A method of detecting the presence of an obstruction in an airflow path of an aerosol-generating system. The system (100) comprises a heater assembly (202) for heating an aerosol-forming substrate (210), a power supply (302), an airflow path defined between an air inlet (218) and an air outlet (306) and passing through the heater assembly (202), and at least one sensor (216) for sensing an airflow property of air in the airflow path. The method comprising: a) measuring a value associated with the airflow property during the course of a user puff based on signals from the at least one sensor: b) comparing this measured value to a predetermined value; and c) detecting an obstruction in the airflow path based on the comparison; and limiting the power supplied to the heater assembly, or providing an indication, if an obstruction is detected.

15 Claims, 6 Drawing Sheets

(51) Int. Cl.

| | |
|---|---|
| ***A24F 40/44*** | (2020.01) |
| ***A24F 40/51*** | (2020.01) |
| ***A24F 40/53*** | (2020.01) |
| ***A24F 40/57*** | (2020.01) |
| ***A24F 40/85*** | (2020.01) |

(56) References Cited

U.S. PATENT DOCUMENTS

| | | | |
|---|---|---|---|
| 2016/0021930 | A1 | 1/2016 | Minskoff |
| 2016/0374397 | A1 | 12/2016 | Jordan |
| 2019/0335817 | A1 | 11/2019 | Freeman |

FOREIGN PATENT DOCUMENTS

| | | |
|---|---|---|
| EP | 3 808 198 | 4/2021 |
| RU | 2603123 | 11/2016 |
| WO | WO 2019/058225 | 3/2019 |

OTHER PUBLICATIONS

PCT International Search Report and Written Opinion for PCT/EP2022/069642 dated Sep. 26, 2022 (11 pages).
International Preliminary Report on Patentability for PCT/EP2022/069642 dated Jun. 7, 2023 (7 pages).
Notice of Allowance issued in Russia for Application No. 2023134250/12 dated Oct. 8, 2025 (11 pages).

AIR PRESSURE MEASUREMENT TO DETECT AN OBSTRUCTION IN AN AIRFLOW PATH

This application is a U.S. National Stage Application of International Application No. PCT/EP2022/069642, which was published in English on Jan. 19, 2023, as International Publication No. WO 2023/285554 A1. International Application No. PCT/EP2022/069642 claims priority to European Application No. 21185651.3 filed Jul. 14, 2021.

The present disclosure relates to a method of detecting the presence of an obstruction in an airflow path of an aerosol-generating system. In particular, the present disclosure relates to a method of detecting the presence of an obstruction caused by agglomeration of aerosol-forming substrate residue in a heater assembly of an aerosol-generating system. The present disclosure also relates to an aerosol-generating system comprising electric circuitry configured to detect the presence of an obstruction in an airflow path.

Aerosol-generating devices configured to generate an aerosol from an aerosol-forming substrate, such as a tobacco-containing substrate, are known in the art. Many known aerosol-generating devices generate aerosol by the application of heat to the substrate by a heater assembly. The heater assembly is heated when it is supplied with power from a power supply of the aerosol-generating device. The generated aerosol can then be inhaled by a user of the device.

Over prolonged use of the aerosol-generating device, residues of aerosol-forming substrate may agglomerate in the heater assembly. This is undesirable because the agglomerated residue may be heated and burnt during continued use of the device if the clogged heater assembly is not replaced or cleaned. Any burnt agglomerated residue may contribute a burnt flavour to the aerosol generated by the device. This negatively affects the user experience of the device.

Aerosol-generating devices typically define an airflow path between an air inlet and an air outlet. The airflow path is configured such that, in use, generated aerosol passes into the airflow path. A user may draw on the air outlet to inhale the generated aerosol.

Often, the airflow path is configured to pass through the heater assembly. In such cases, clogging of the heater assembly by agglomerated residues of aerosol-forming substrate will increase the resistance to draw of air passing through the airflow path when a user draws on the aerosol-generating device in use. This is because the agglomerated residue creates an obstruction in the airflow path. An increased resistance to draw may be associated with a poor user experience.

It would be desirable to provide a method of detecting when the heater assembly of an aerosol-generating device has become clogged. It would be desirable to provide such a method which is unobtrusive to the user experience of the device and which is simple and low cost. It would also be desirable to provide a method that can detect a clogged heater assembly that is accurate irrespective of the user of the device. It would be desirable to provide an aerosol-generating system for performing the method.

According to a first aspect of the present disclosure there is provided a method of detecting the presence of an obstruction in an airflow path of an aerosol-generating system. The system may comprise a heater assembly for heating an aerosol-forming substrate. The system may further comprise a power supply. The system may further comprise an airflow path defined between an air inlet and an air outlet. The airflow path may pass through the heater assembly. The system may comprise at least one sensor for sensing an airflow property of air in the airflow path.

The method may comprise measuring a value associated with the airflow property based on signals from the at least one sensor. The value may be measured during the course of a user puff. The method may comprise comparing the measured value to a predetermined value. The method may comprise detecting an obstruction in the airflow path based on the comparison. The method may comprise limiting the power supplied to the heater assembly if an obstruction is detected. Alternatively, the method may comprise providing an indication if an obstruction is detected.

By detecting the obstruction and either limiting power supplied to the heater assembly or providing an indication, the user is advantageously made aware of the obstruction. By detecting the obstruction, and making the user aware of its existence, the user can advantageously cease using the aerosol-generating system and take appropriate action to remove the obstruction.

Limiting power may comprise preventing power from being supplied to the heater assembly.

The indication may preferably be in the form of providing power to an LED of the aerosol-generating system. However, other means for providing an indication are also possible. This includes haptic feedback, for example. Alternatively, the aerosol-generating system may be configured to communicate with a smartphone or other electronic device and may be configured to provide the indication on that smartphone or electronic device.

As used herein, an obstruction means a full or partial blockage in the airflow path.

As above, the obstruction may be detected based on the measured value of the airflow property. For example, the airflow property may be pressure. An obstruction will cause a pressure drop in the airflow path. Assuming a user draws air through the airflow path from the air outlet such that air flow is driven by the user's inhalation, pressure may be lower downstream of the obstruction than if the obstruction was not present. The pressure may be lowest in a region immediately downstream of the obstruction. Another example of an airflow property that can used is flow rate. The flow rate may be higher downstream of the obstruction than if the obstruction was not present. The flow speed may be highest in a region immediately downstream of the obstruction.

Because the method merely requires the presence of one or more sensors for measuring an airflow property, the method advantageously is simple and low cost to implement in an aerosol-generating system. Furthermore, as the method can be carried out during a puff, it is advantageously unobtrusive to a user of the aerosol-generating system.

The obstruction may be in a portion of the airflow path that passes through the heater assembly. The obstruction may be caused by the agglomeration of aerosol-forming substrate residue in the heater assembly. The residue may effectively cause a restriction in portion of the airflow path that passes through the heater assembly.

By making the user aware of the obstruction, the user can advantageously cease using the aerosol-generating system and so avoid heating or burning of the residue which would otherwise negatively affect the taste of aerosol generated by the aerosol-generating system.

A heater assembly that is obstructed by an agglomeration of aerosol-forming substrate residue may be referred to as "clogged".

The predetermined value may be a value for the airflow property in normal use, without an obstruction present in the airflow path. The predetermined value may represent the value of the airflow property during an initial use of aerosol-generating system. This may be particularly advantageous when the obstruction is caused by an agglomeration of aerosol-forming substrate residue because the value will represent the airflow property with minimal residue build up.

Where the predetermined value is a value for the airflow property in normal use, without an obstruction present in the airflow path, the comparison with the predetermined value may comprise calculating the difference between the predetermined value and the measured value. As will be appreciated, whether the difference is positive or negative will depend on the airflow property, the setup of the at least one sensor and the order of the calculation.

An obstruction may be detected when the magnitude of the difference between the predetermined value and the measured value exceeds a predetermined limit. The predetermined limit may correspond to a pressure difference of between 60 and 160 Pa. Preferably, the predetermined limit may correspond to a pressure difference of between 80 and 150 Pa.

The predetermined value may be a predetermined threshold. The predetermined threshold may represent a value for the airflow property representative of the airflow path being obstructed. The comparison of the measured value with the predetermined threshold may comprise a direct comparison. An obstruction may be detected if the measured value is the same as the predetermined threshold. For airflow properties that decrease in response to an obstruction, an obstruction may be detected if the measured value is less than the predetermined threshold. For airflow properties that increase in response to an obstruction, an obstruction may be detected if the measured value is greater than the predetermined threshold.

The measured value used in the comparison with the predetermined value or threshold may be a value a measured during the course of a single puff. The measured value may be an average of several measurements taken at different times during the course of a single puff.

The measured value may be an average of values for the airflow property measured during a plurality of puffs. The average value may be measured over the course of successive puffs, for example 2, 3, 4 or 5 successive puffs. An average may advantageously avoid false detection of an obstruction as a result of unusual user behaviour during a single puff.

The step of detecting an obstruction may only be carried out after a predetermined number of puffs of the device after an initial puff. The step of detecting an obstruction may only be carried out only after predetermined period of time after an initial puff. The step of detecting an obstruction may only be carried out after a predetermined duration of use of the device. In each of the above cases, the device may be configured to monitor usage. The predetermined number of puffs, predetermined period of time or predetermined duration of use may be chosen as corresponding to an amount of use of the device after which an obstruction may be expected. This may be particularly advantageous when the obstruction to be detected is an agglomeration of aerosol-forming substrate residue caused by prolonged usage of the device. In this way, the method may advantageously not carried be out when there is a very low chance of there being an obstruction.

The method may further comprise, after an obstruction has been detected, the step of limiting the power supplied to the heater assembly until the obstruction has been removed. This advantageously prevents the user from using the aerosol-generating system until the obstruction has been removed.

The method may further comprise the step of removing the obstruction. The step of removing the obstruction may comprise replacing the heater assembly.

The step of replacing the heater assembly may comprise removing the heater assembly and replacing it with a new heater assembly. As above, the obstruction may be in a portion of the airflow path that passes through the heater assembly. The obstruction may be caused by aerosol-forming substrate residue build-up in the heater assembly itself. The new heater assembly may not comprise an obstruction. In particular, the new heater assembly may not comprise any aerosol-forming substrate residue. Thus, replacing the heater assembly with a new heater assembly may advantageously remove the obstruction in the airflow path.

Alternatively, the step of replacing the heater assembly may comprise removing, cleaning and then replacing the heater assembly. The step of cleaning the heater assembly may comprise removing the obstruction.

The aerosol-generating system may comprise a cartridge and an aerosol-generating device. The cartridge may be configured to be used with the device. For example, the device may comprise a device housing defining a cavity configured to receive at least a portion of the cartridge in use. In such an arrangement, the cartridge may advantageously be disposable and the device may be reusable.

The cartridge may comprise the heater assembly. If so, the step of removing the heater assembly, as described above, may comprise removing the cartridge from the cavity of the device. Replacing the heater assembly with a new heater assembly, as described above, may comprise replacing the entire cartridge with a new cartridge.

The heater assembly of the cartridge may be positioned such that it is inaccessible when the cartridge is received in the cavity. The heater assembly may be positioned such that removing the cartridge from the cavity allows access to the heater assembly. So, following removal the cartridge from the cavity, it is advantageously possible to clean the heater assembly to remove any obstructions. The cartridge with cleaned heater assembly may then be re-inserted into the cavity.

Alternatively to replacing the heater assembly, the step of removing the obstruction may comprise cleaning the heater assembly while the heater assembly remains connected to the aerosol-generating device. The step of cleaning the heater assembly may comprise supplying power to the heater assembly between user puffs. This results in heating of the heater assembly. This heating of the heater assembly may advantageously remove the obstruction. In particular, when the obstruction is caused by aerosol-forming substrate residue, the residue may be heated by the heater assembly. This may advantageously result in pyrolysis of the residue. Because this heating is between puffs, it does not matter that heating the residue in this way may generate burnt tasting aerosol as the user does not inhale the aerosol. The power supplied to the heater assembly between user puffs may be greater than the power supplied to the heater assembly during the course of a user puff.

The aerosol-forming substrate may be a liquid aerosol-forming substrate.

As used herein, the term "aerosol-forming substrate" denotes a substrate consisting of or comprising an aerosol-forming material that is capable of releasing volatile compounds upon heating to generate an aerosol.

As used herein, the term "aerosol-forming material" denotes a material that is capable of releasing volatile compounds upon heating to generate an aerosol. An aerosol-forming substrate may comprise or consist of an aerosol-forming material.

The aerosol-forming substrate may comprise an aerosol former. As used herein, the term "aerosol-former" refers to any suitable compound or mixture of compounds that, in use, facilitates formation of an aerosol, for example a stable aerosol that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

The aerosol-forming substrate may comprise nicotine. The aerosol-forming substrate may comprise water. The aerosol-forming substrate may comprise glycerol, also referred to as glycerine, which has a higher boiling point than nicotine. The aerosol-forming substrate may comprise propylene glycol. The aerosol-forming substrate may comprise plant-based material. The aerosol-forming substrate may comprise homogenised plant-based material. The aerosol-forming substrate may comprise tobacco. The aerosol-forming substrate may comprise a tobacco-containing material. The tobacco-containing material may contain volatile tobacco flavour compounds. These compounds may be released from the aerosol-forming substrate upon heating. The aerosol-forming substrate may comprise homogenised tobacco material. The aerosol-forming substrate may comprise other additives and ingredients, such as flavourants.

As used herein, the term "liquid aerosol-forming substrate" is used to refer to an aerosol-forming substrate in condensed form. Thus, the "liquid aerosol-forming substrate" may be, or may comprise, one or more of a liquid, gel, or paste. If the liquid aerosol-forming substrate is, or comprises, a gel or paste, the gel or paste may liquidise upon heating. For example, the gel or paste may liquidise upon heating to a temperature of less than 50, 75, 100, 150, or 200 degrees Celsius.

The liquid aerosol-forming substrate may be contained in a liquid storage portion. The liquid storage portion may be defined by a housing of the aerosol-generating system. The liquid storage portion may be defined between an inner wall and an outer wall of the housing. Preferably, the aerosol-forming substrate may be contained in an annular space defined between the inner and outer walls. The inner wall may be define an internal passage through the liquid storage portion. The airflow path may pass through the internal passage of the liquid storage portion.

The heater assembly may comprise a wick. The wick may be configured to draw liquid aerosol-forming substrate towards a heater element of the heater assembly. The wick may be in fluid communication with liquid aerosol-forming substrate stored in the liquid storage portion.

The airflow path may pass through the wick. The wick may extend across the internal passage. The wick may extends across an entrance to the internal passage.

The obstruction may be in the portion of the airflow path that passes through the wick. The obstruction may be in the wick itself. The obstruction may be caused by agglomeration of liquid aerosol-forming substrate residue in the wick.

The wick may be a ceramic wick. The wick may be an air-permeable ceramic wick. The air flow through the portion of the airflow path passing through the wick may pass through pores of the air-permeable ceramic wick.

The obstruction may be in the pores of the air-permeable ceramic wick. The obstruction may be caused by agglomeration of aerosol-forming substrate residue in the heater assembly. The residue may agglomerate in the pores of the wick.

The method may advantageously be particularly sensitive when the aerosol-generating device comprises an air-permeable ceramic wick. As above, air may pass through pores of the wick. As the pores may be relatively small, the build-up of residue in each of the pores will have a relatively large effect in restricting airflow. Thus, the change in airflow properties may be particularly pronounced when comparing airflow through an unobstructed wick to an obstructed wick comprising residue build-up.

The heater assembly may comprise a heating element configured to heat up when power is supplied to the heater assembly. The airflow path may pass through the heating element. The obstruction may be in the portion of the airflow path passing through the heating element. The obstruction may be caused by agglomeration of aerosol-forming substrate on the heating element itself. Such residue may be particularly likely to be overheated or burnt during heating. So, the method of the first aspect may be particularly advantageous when the airflow path passes through the heater assembly.

The heating element may be in the form of a mesh heater. The mesh heater may comprise a plurality of electrically conductive filaments. The electrically conductive filaments may form a mesh of size between 160 and 600 Mesh US (+/−10%) (i.e. between 160 and 600 filaments per inch (+/−10%)). The width of the interstices may preferably be between 75 μm and 25 μm. The obstruction may be an obstruction in the mesh heater. The filaments of a mesh heater may provide a relatively high surface area onto which aerosol-forming substrate residue may form. Thus, the agglomeration of aerosol-forming substrate residue may be a particular problem for mesh heaters. So, the method of the first aspect may be particularly advantageous when the airflow path passes through a mesh heater of a heater assembly.

The method may advantageously be particularly sensitive when the aerosol-generating device comprises a mesh heater. Air passing through the mesh heater may pass through the interstices between filaments. As the interstices may be relatively small, the build-up of residue on each of the filaments will have a relatively large effect in restricting airflow. Thus, the change in airflow properties may be particularly pronounced when comparing airflow through an unobstructed mesh heater to an obstructed mesh heater comprising residue build-up.

The airflow property measured by the at least one sensor may be any airflow property that changes in response to the presence of a restriction in an airflow path. Preferably, the airflow property may be a fluid mechanical property. More preferably, the airflow property may be pressure, flow speed or volumetric flow rate. The airflow property may also be a differential airflow property. Preferably, the airflow property may be differential pressure. Other suitable airflow properties includes environmental properties. For example, the temperature or humidity of air flowing through the airflow path will also be affected by the obstruction.

The at least one sensor may comprise a sensor for measuring a fluid mechanical property. Preferably, the at least one sensor may comprise a pressure sensor, a flow speed sensor or a volume sensor. The at least one sensor may comprise a temperature sensor or a humidity sensor. The sensor may be a MEMS sensor.

The aerosol-generating system may comprises at least a first sensor. The first sensor may be downstream of the heater assembly. It may be advantageous to position the first sensor downstream of the heater assembly because the effect of the obstruction on the airflow property may be greater downstream of the obstruction than upstream of the obstruction. This may advantageously mean that the obstruction can be detected with greater accuracy. The closer the first sensor may be to the heater assembly, while being downstream of the heater assembly, the greater the airflow property may be affected by an obstruction in the heater assembly. Again, this may advantageously mean that the obstruction can be detected with greater accuracy. The first sensor may be less than 5 centimetres from the heater assembly, preferably less than 4 centimetres from the heater assembly, preferably less than 3 centimetres from the heater assembly, preferably less than 2 centimetres from the heater assembly.

As used herein, the terms "upstream" and "downstream" are used to describe the relative positions of elements, or portions of elements, of the aerosol-generating system or cartridge in relation to the direction in which a user draws on the aerosol-generating system or cartridge during use thereof.

The first sensor may be the only sensor.

Preferably, the aerosol-generating system may comprise at least a first sensor downstream of the heater assembly and a second sensor upstream of the heater assembly. In this case, the value measured during the course of a user puff may advantageously be a differential value. For example, if the first and second sensors are pressure sensors, the value measured during the course of a user puff may be a differential pressure measurement. A differential pressure measurement may advantageously be more reliable than a single pressure measurement. A differential measurement may allow for better identification of an obstruction because factors influencing the measurements of both the first and second sensors can be eliminated. For example, factors such as puffs strength variation and noise, which may be detected by both the first the second sensors, may be eliminated when the difference between the measurements of those sensor is determined.

The magnitude of the differential pressure may increase when the airflow path comprises an obstruction in the heater assembly compared to when the airflow path does not comprise the obstruction. This is because the obstruction may cause a pressure drop through the portion of the airflow path passing through the heater assembly which may be detected by the first and second sensors placed either side of the heater assembly.

The step of measuring the value associated with the airflow property may comprise calculating the difference between a signal from the first sensor and a signal from the second signal. This may result in a differential value being calculated.

The method may further comprise the step of determining the predetermined value during a threshold determining phase comprising one or more user puffs. Determining the predetermined value during a threshold determining phase may advantageously mean that the predetermined value can be user specific rather than being a value that is set during manufacture. Different users may have different puff characteristics when using the aerosol-generating system. For example, a first user may typically have a stronger puff strength than a second user. This means that the same predetermined value for the first user may not be suitable for the second user. Using an inappropriate predetermined value for the airflow property may result in inaccurate detection of an obstruction when an obstruction is not actually present or failure to detect an obstruction when an obstruction is actually present. By determining the predetermined value during a threshold determining phase, the predetermined value may advantageously be chosen to complement the user and so may advantageously improve the accuracy of the method.

The step of determining the predetermined value may comprise measuring a value associated with the property of air during the course of each user puff during the threshold determining phase. The predetermined value may be determined based on the one or more measurements.

The threshold determining phase may comprise more than one puff. The predetermined value may be determined based on an average of the measured values from each puff of the threshold determining phase.

The threshold determining phase may comprise two, three or four puffs. Preferably, the threshold determining phase comprises five puffs.

The first puff of the threshold determining phase may be triggered when a user first puffs on the aerosol-generating system. In other words, the first puff of the threshold determining phase may represent the first usage of the heater assembly. This may be advantageous when the obstruction is caused by an agglomeration of aerosol-forming substrate residue as it means that the measured value during each puff of threshold determining phase represents a value of the airflow property when the airflow path is unobstructed and comprises minimal aerosol-forming substrate residue.

Alternatively or additionally, a user may trigger the threshold determining phase at a later time. Preferably, the aerosol-generating system may comprise a user interface which the user may use to trigger the threshold determining phase. This may advantageously allow the predetermined value to be modified during use of the aerosol-generating system. This may be advantageous, for example, if the aerosol-generating is being used by a different user whose typical puff profile is different to a previous user. The threshold determining phase may comprise the next one or more puffs.

Alternatively, the threshold determining phase may comprise the last one or more puffs. In this case, the aerosol-generating system may maintain a record of the measured value of the airflow property during each puff stored in a memory of electric circuitry of the aerosol-generating system. The predetermined value may be determined based on the stored values.

The steps of the method associated with detecting an obstruction in the airflow path may not be carried out during the threshold determining phase.

As described above, the predetermined value may be a value for the airflow property in normal use, without an obstruction in the airflow path. In that case, the predetermined value may be determined directly from the measured values of the airflow property during the threshold determining phase. For example, when the predetermined value is based on an average of the measured values from each puff of the threshold determining phase, the predetermined value may be equal to the average.

Alternatively, as described above, the predetermined value may be a predetermined threshold. In this case, the step of determining the predetermined value as a predetermined threshold may further comprise converting the measured value, or an average measured value calculated over two or more puffs, into the predetermined threshold.

The conversion may comprise increasing or decreasing the measured value or average measured value by a predetermined amount. The predetermined amount may be correspond to a pressure between 60 and 160 Pa. Preferably, the predetermined amount may correspond to a pressure between 80 and 150 Pa. The conversion may comprise decreasing the average of the measured value if the measured value represents pressure. The conversion may comprise increasing the average of the measured value if the measured value represents differential pressure or flow speed.

The conversion may comprise increasing or decreasing the average value by a scale factor. The scale factor may be predetermined. The scale factor may be factor by which the intermediate value is multiplied to arrive at the predetermined threshold. The scale factor may advantageously be selected as representing the amount the airflow property will typically increase or decrease as a result of an obstruction compared to the airflow property without an obstruction.

In a second aspect there is provided an aerosol-generating system. The aerosol-generating system may comprise a heater assembly for heating an aerosol-forming substrate. The aerosol-generating system may comprise a power supply. The aerosol-generating system may comprise an airflow path. The airflow path may be defined between an air inlet and an air outlet. The airflow path may pass through the heater assembly. The aerosol-generating system may comprise at least one sensor for sensing an airflow property of air in the airflow path.

The aerosol-generating system may comprise electric circuitry. The electric circuitry may comprise a memory. The electric circuitry may be connected to the heater assembly and to the power supply. The electric circuitry may be configured to measure a value associated with the airflow property during the course of a user puff. The electric circuitry may be configured to base the measured value on signals from the at least one sensor. The electric circuitry may be configured to compare this measured value with a predetermined value.

The electric circuitry may be configured to detect an obstruction in the airflow path based on the comparison. The electric circuitry may be configured to limit the power supplied to the heater assembly if an obstruction is detected until the obstruction has been removed.

The advantages of detecting an obstruction based on a comparison of the measured value associated with the airflow property with a predetermined value have already been discussed with respect to the first aspect. The same advantages apply to the second aspect.

Furthermore, other features described in relation to the first aspect in relation to the method also apply to the second aspect in relation to the system.

The electric circuitry may be configured to perform the method of the first aspect.

The power supply may be a battery. The battery may be a rechargeable battery. The power supply may be configured to supply power to the heater assembly.

The aerosol-generating system may comprise an aerosol-forming substrate. The aerosol-forming substrate may be a liquid aerosol-forming substrate. The liquid aerosol-forming substrate may be contained in a liquid storage portion. The liquid storage portion may be defined by a housing of the aerosol-generating system. The liquid storage portion may be defined between an inner wall and an outer wall of the housing. Preferably, the aerosol-forming substrate may be contained in an annular space defined between the inner and outer walls. The inner wall may be define an internal passage through the liquid storage portion. The airflow path may pass through the internal passage of the liquid storage portion.

The aerosol-forming substrate may be adsorbed, coated, impregnated or otherwise loaded onto a carrier or support. In one example, the aerosol-forming substrate is a liquid substrate held in capillary material. The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid to the heater. Alternatively, the capillary material may comprise sponge-like or foam-like material. The structure of the capillary material forms a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics materials, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the capillary material by capillary action. The capillary material may be configured to convey the aerosol-forming substrate to the heater assembly.

The capillary material may be contained in the liquid storage portion. The capillary material may fill the liquid storage portion.

The heater assembly may comprise a wick. The wick may be configured to draw liquid aerosol-forming substrate towards a heater element of the heater assembly. The wick may be in fluid communication with liquid aerosol-forming substrate stored in the liquid storage portion.

The airflow path may pass through the wick. The wick may extend across the internal passage. The wick may extends across an entrance to the internal passage.

The obstruction may be in the portion of the airflow path that passes through the wick. The obstruction may be in the wick itself. The obstruction may be caused by agglomeration of liquid aerosol-forming substrate residue in the wick.

The wick may be an air-permeable ceramic wick. The air flow through the portion of the airflow path passing through the wick may pass through pores of the air-permeable ceramic wick.

The obstruction may be in the pores of the air-permeable ceramic wick. The obstruction may be caused by agglomeration of aerosol-forming substrate residue in the heater assembly. The residue may agglomerate in the pores of the wick.

The heater assembly may comprise a heating element configured to heat up when power is supplied to the heater assembly.

The airflow path may pass through the heating element. The obstruction may be in the portion of the airflow path passing through the heating element. The obstruction may be caused by agglomeration of aerosol-forming substrate on the heating element itself.

The heating element may be configured to heat the ceramic wick in use. This may result in heating of, and vaporization of, aerosol-forming substrate contained in the ceramic wick. The heating element may be in contact with the ceramic wick. Heat may be conducted from the heating element to the ceramic wick. Alternatively or additionally, heating element may be configured to draw aerosol-forming substrate from the wick. The heating element may then be configured to heat that aerosol-forming substrate directly. The heating element may be in the form of conductive tracks on the wick. The tracks of the heating element may be printed on the wick.

Preferably, the heating element may be in the form of a mesh. The mesh may be configured such that aerosol-forming substrate is drawn into interstices between filaments of the mesh. This may advantageously provide more efficient heating of the aerosol-forming substrate by the heating element.

The heater element of the heater assembly may be a resistively heatable heating element. The power supply may be configured to supply power to the heating element to resistively heat the heating element. The heating element may comprise or be formed from any material with suitable electrical and mechanical properties. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The wires may be coated with one or more electrical insulators. Preferred materials may be 304, 316, 304 L, 316L stainless steel, and graphite.

The heater element may be a susceptor element. As used herein, a "susceptor element" means a conductive element that heats up when subjected to a changing magnetic field. This may be the result of eddy currents induced in the susceptor element and/or hysteresis losses. Possible materials for the susceptor elements include graphite, molybdenum, silicon carbide, stainless steels, niobium, aluminium and virtually any other conductive elements. Advantageously the susceptor element is a ferrite element. The material and the geometry for the susceptor element can be chosen to provide a desired electrical resistance and heat generation.

A heater assembly comprising a susceptor element as a heating element may further comprise an inductor coil. The susceptor element may be positioned relative to the inductor coil such that the susceptor element is heated when a high frequency oscillating current is passed through the inductor coil. The power supply of the aerosol-generating system may be configured to provide an alternating current to the inductor coil.

The aerosol-generating system may comprise at least a first sensor for sensing an airflow property of air in the airflow path. The first sensor may be downstream of the heater assembly.

The first sensor may be the only sensor.

Preferably, the aerosol-generating system may comprise at least a first sensor downstream of the heater assembly and a second sensor upstream of the heater assembly. In this case, the electric circuitry may be configured to calculate the difference between signals from the first and second sensors as part of measuring a value associated with the airflow property. This may result in a differential value being calculated.

The obstruction may be in a portion of the airflow path that passes through the heater assembly. The obstruction may be caused by the agglomeration of aerosol-forming substrate residue in the heater assembly.

The predetermined value may be a value for the airflow property in normal use, without an obstruction present in the airflow path. The predetermined value may represent the value of the airflow property in an initial use of aerosol-generating system. The comparison with the predetermined value may comprise the electric circuitry being configured to calculate the difference between the predetermined value and the measured value. As will be appreciated, whether the difference is positive or negative will depend on the airflow property, the setup of the at least one sensor and the order of the calculation.

The electric circuitry may be configured to detect an obstruction when the magnitude of the difference exceeds a predetermined limit. An obstruction may be detected when the magnitude of the difference between the predetermined value and the measured exceeds a predetermined limit. The predetermined limit may correspond to a pressure between 60 and 160 Pa. Preferably, the predetermined limit may correspond to a pressure between 80 and 150 Pa.

Alternatively, the predetermined value may be a predetermined threshold. The predetermined threshold may represent a value for the airflow property representative of the airflow path being obstructed. The electric circuitry may be configured to directly compare the measured value with the predetermined threshold.

The electric circuitry may be further configured to determine the predetermined value during a threshold determining phase comprising one or more user puffs. The electric circuitry may be configured to measure a value associated with the property of air during the course of each user puff during the threshold determining phase. The predetermined value may be determined based on the one or more measurements.

The threshold determining phase may comprise more than one puff. The predetermined value may be determined based on an average of the measured values from each puff of the threshold determining phase.

The threshold determining phase may comprise two, three or four puffs. Preferably, the threshold determining phase comprises five puffs.

The electric circuitry may be configured such that the threshold determining phase begins when a user first puffs on the aerosol-generating system. In other words, the first puff of the threshold determining phase may represent the first usage of the heater assembly.

Alternatively or additionally, the electric circuitry may be configured such that the user can initiate the threshold determining phase at a later time. Preferably, the aerosol-generating system may comprise a user interface which the user may use to trigger the threshold determining phase.

The threshold determining phase may comprise the next one or more puffs. Alternatively, the threshold determining phase may comprise the last one or more puffs. In this case, the electric circuitry may be configured to maintain a record of the measured value of the airflow property during each puff stored in a memory of electric circuitry of the aerosol-generating system. The predetermined value may be determined based on the stored values.

As described above, the predetermined value may be a value for the airflow property in normal use, without an obstruction in the airflow path. In that case, the electric circuitry may be configured to determine the predetermined value directly from the measured values of the airflow property during the threshold determining phase. For example, when the predetermined value is based on an average of the measured values from each puff of the threshold determining phase, the predetermined value may be equal to the average.

Alternatively, as described above, the predetermined value may be a predetermined threshold. In this case, the electric circuitry may be configured to convert the average of the measured value from each of the threshold determining phase into a threshold.

The conversion may comprise increasing or decreasing the average of the measured value by a predetermined amount. The predetermined amount may correspond to a pressure between 60 and 160 Pa. Preferably, the predetermined amount may correspond to a pressure between 80 and 150 Pa. The conversion may comprise decreasing the average of the measured value if the measured value represents pressure. The conversion may comprise increasing the average of the measured value if the measured value represents differential pressure or flow speed.

The conversion may comprise increasing or decreasing the average value by a scale factor. The scale factor may be predetermined. The scale factor may be factor by which the intermediate value is multiplied to arrive at the predetermined threshold. The scale factor may advantageously be selected as representing the amount the airflow property will typically increase or decrease as a result of an obstruction compared to the airflow property without an obstruction.

The obstruction may be removed by replacing the heater assembly. Replacing the heater assembly may comprise removing the heater assembly and replacing it with a new heater assembly. Alternatively, replacing the heater assembly may comprise removing, cleaning and then replacing the heater assembly.

Alternatively, the step of removing the obstruction may comprise cleaning the heater assembly while the heater assembly remains connected to the aerosol-generating device. In such cases, the electric circuitry may be configured supply power to the heater assembly between user puffs. The power supplied to the heater assembly between user puffs may be greater than the power supplied to the heater assembly during the course of a user puff. The obstruction may be caused by aerosol-forming substrate residue. The power supplied may be sufficient to heat the heater assembly high enough to result in pyrolysis of the residue.

The aerosol-generating system may comprise a cartridge and aerosol-generating device. The cartridge may be configured to be used with the device. For example, the device may comprise a device housing defining a cavity configured to receive at least a portion of the cartridge in use. In such an arrangement, the cartridge may advantageously be disposable and the device may be reusable. The power supply may be configured to supply power to the heater assembly only when the cartridge is engaged with the aerosol-generating device.

The cartridge may comprise at least a portion of the heater assembly. Preferably, the cartridge may comprise the heater element of the heater assembly. When the heater assembly comprises both a susceptor element and an inductor coil, the cartridge may at least comprise the susceptor element. The cartridge may further comprise the inductor coil.

Alternatively, the aerosol-generating device may comprise the inductor coil. The cartridge and the aerosol-generating device may be configured such that when the cartridge is received by the device, the susceptor is positioned to be heated by the inductor coil to generate an aerosol.

The cartridge may comprise aerosol-forming substrate. When the aerosol-forming substrate is a liquid aerosol-forming substrate contained in a liquid storage portion, the cartridge may comprise the liquid storage portion. The housing defining the liquid storage portion may be a cartridge housing.

The aerosol-generating device may comprise the power supply.

The air outlet of the airflow path may be defined in a mouthpiece portion of the aerosol-generating system. The cartridge may comprise the mouthpiece. In use, when the cartridge is engaged with an aerosol-generating device, a user may puff on the mouthpiece of the cartridge. This may cause air to flow in through the air inlet, then across, over, past, or through the heater assembly or heating element, then through the air outlet.

Below, there is provided a non-exhaustive list of non-limiting examples. Any one or more of the features of these examples may be combined with any one or more features of another example, embodiment, or aspect described herein.

EX1. A method of detecting the presence of an obstruction in an airflow path of an aerosol-generating system, the system comprising a heater assembly for heating an aerosol-forming substrate, a power supply, an airflow path defined between an air inlet and an air outlet and passing through the heater assembly, and at least one sensor for sensing an airflow property of air in the airflow path; the method comprising:

measuring a value associated with the airflow property during the course of a user puff based on signals from the at least one sensor;

comparing this measured value to a predetermined value;

detecting an obstruction in the airflow path based on the comparison; and limiting the power supplied to the heater assembly, or providing an indication, if an obstruction is detected.

EX2. A method according to EX1, wherein the obstruction is in a portion of the airflow path that passes through the heater assembly.

EX3. A method according to EX1 or EX2, wherein the obstruction is caused by the agglomeration of aerosol-forming substrate residue in the heater assembly.

EX4. A method according to any one of the preceding examples, wherein the predetermined value is a value for the airflow property in normal use, without an obstruction present in the airflow path.

EX5. A method according to any one of the preceding examples, wherein the predetermined value represents the value of the airflow property in an initial use of the aerosol-generating system.

EX6. A method according to any one of the preceding examples, wherein the comparison with the predetermined value comprises calculating the difference between the predetermined value and the measured value.

EX7. A method according to example EX6, wherein an obstruction is detected when the magnitude of the difference between the predetermined value and the measured exceeds a predetermined limit.

EX8. A method according to example EX7, wherein the predetermined limit corresponds to a pressure between 60 and 160 Pa.

EX9. A method according to any one of examples EX1 to EX3, wherein the predetermined value is predetermined threshold representative of a value for the airflow property when the airflow path is obstructed.

EX10. A method according to EX9, wherein the comparison of the measured value with the predetermined threshold is a direct comparison.

EX11. A method according to EX19, wherein an obstruction is detected if the measured value is the same as the predetermined threshold or, for airflow properties that decrease in response to an obstruction, if the measured value is less than the predetermined threshold or, for airflow properties that increase in response to an obstruction, if the measured value is greater than the predetermined threshold.

EX12. A method according to any one of the preceding examples, further comprising, after an obstruction has been detected, the step of limiting the power supplied to the heater assembly until the obstruction has been removed.

EX13. A method according to any one of the preceding examples, further comprising the step of removing the obstruction.

EX14. A method according to example EX13, wherein removing the obstruction comprises replacing the heater assembly.

EX15. A method according to example EX14, wherein the step of replacing the heater assembly comprises removing the heater assembly and replacing it with a new heater assembly.

EX16. A method according to example EX14, wherein the step of replacing the heater assembly comprises removing, cleaning and then replacing the heater assembly.

EX17. A method according to example EX16, wherein the step of cleaning the heater assembly comprises removing the obstruction.

EX18. A method according to any one of examples EX13 to EX17, wherein the aerosol-generating system comprises a cartridge and an aerosol-generating device, the cartridge being configured to be used with the device and comprising the heater assembly, wherein the step of removing the heater assembly comprises removing the cartridge from the cavity of the device.

EX19. A method according to EX 12 or EX13, wherein removing the obstruction comprises cleaning the heater assembly while the heater assembly remains connected to the aerosol-generating device.

EX20. A method according to EX19, wherein supplying power to the heater assembly between user puffs.

EX21. A method according to EX20, wherein the power supplied to the heater assembly between user puffs is greater than the power supplied to the heater assembly during the course of a user puff.

EX22. A method according to any one of the preceding examples, wherein the aerosol-forming substrate is a liquid aerosol-forming substrate.

EX23. A method according to example EX22, wherein the liquid aerosol-forming substrate is contained in a liquid storage portion defined by a housing of the aerosol-generating system.

EX24. A method according to EX23, wherein the liquid storage portion is defined between an inner wall and an outer wall of the housing.

EX25. A method according to EX24, wherein the inner wall defines an internal passage through the liquid storage portion, the airflow path passing through the internal passage.

EX26. A method according to any one of the preceding example, wherein the heater assembly comprises a wick configured to draw liquid aerosol-forming substrate towards a heater element of the heater assembly.

EX27. A method according to example EX26, wherein the airflow path passes through the wick.

EX28. A method according to example EX27, wherein the liquid aerosol-forming substrate is contained in a liquid storage portion defined between an inner wall and an outer wall of a housing of the aerosol-generating system, the inner wall defining an internal passage through the liquid storage portion through which the airflow path passes, and wherein the wick extends across the internal passage.

EX29. A method according to EX28, wherein the wick extends across an entrance to the internal passage.

EX30. A method according to any one of the preceding examples, wherein the heater assembly comprises a heating element configured to heat up when power is supplied to the heater assembly and wherein the airflow path may pass through the heating element.

EX31. A method according to example EX30, wherein the heating element is in the form of a mesh heater.

EX32. A method according to any one of the preceding examples, wherein the airflow property is a fluid mechanical property such as pressure, flow speed or volume.

EX33. A method according to any one of the preceding examples, wherein the at least one sensor comprises a sensor for measuring a fluid mechanical property such as a pressure sensor, a flow speed sensor or a volume sensor.

EX34. A method according to any one of the preceding examples, wherein the aerosol-generating system comprises at least a first sensor downstream of the heater assembly.

EX35. A method according to example EX34, wherein the first sensor is less than 5 centimetres from the heater assembly, preferably less than 4 centimetres from the heater assembly, preferably less than 3 centimetres from the heater assembly, preferably less than 2 centimetres from the heater assembly.

EX36. A method according to example EX34 or EX35, wherein the first sensor is the only sensor.

EX37. A method according to any one of examples EX1 to EX35, wherein the aerosol-generating system comprises at least a first sensor downstream of the heater assembly and a second sensor upstream of the heater assembly.

EX38. A method according to example EX37, wherein the step of measuring the value associated with the airflow property comprises calculating the difference between a signal from the first sensor and a signal from the second sensor.

EX39. A method according to any one of the preceding examples, wherein the method further comprises the step of determining the predetermined value during a threshold determining phase comprising one or more user puffs.

EX40. A method according to example EX39, wherein the step of determining the predetermined value comprises measuring a value associated with the property of air during the course of each user puff during the threshold determining phase.

EX41. A method according to example EX39 or EX40, wherein the threshold determining phase comprises more than one puff.

EX42. A method according to example EX41, wherein the predetermined value is determined based on an average of the measured values from each puff during the threshold determining phase.

EX43. A method according to any one of examples EX39 to EX42, wherein the first puff of the threshold determining phase is triggered when a user first puffs on the aerosol-generating system.

EX44. A method according to any one of examples EX39 to EX43, wherein the first puff of the threshold determining phase is triggered by the user at any time.

EX45. A method according to example EX44, wherein the aerosol-generating system comprises a user interface which the user can use to trigger the threshold determining phase.

EX46. A method according to example EX44 or EX45, wherein the threshold determining phase comprises the next one or more puffs.

EX47. A method according to example EX44 or EX45, wherein the threshold determining phase comprises the last one or more puffs.

EX48. A method according to any one of examples EX39 to EX47, wherein the predetermined value is determined directly from the measured values of the airflow property during the threshold determining phase.

EX49. A method according to any one of examples EX39 to EX47, wherein the predetermined value is a predetermined threshold and the step of determining the predetermined value as a predetermined threshold further comprises converting the measured value, or an average measured value calculated over two or more puffs, into the predetermined threshold.

EX50. A method according to examples EX49, wherein the conversion comprises increasing or decreasing the measured value or average measured value by a predetermined amount.

EX51. A method according to example EX50, wherein the predetermined amount corresponds to a pressure between 60 and 160 Pa.

EX52. A method according to example EX51, wherein the predetermined amount corresponds to a pressure between between 80 and 150 Pa.

EX53. An aerosol-generating system comprising:

a heater assembly for heating an aerosol-forming substrate;

a power supply;

an airflow path defined between an air inlet and an air outlet, the airflow path passing through the heater assembly;

at least one sensor for sensing an airflow property of air in the airflow path; and electric circuitry comprising a memory and connected to the heater assembly and to the power supply, the electric circuitry being configured to measure a value associated with the airflow property during the course of a user puff based on signals from the at least one sensor and to compare this measured value with a predetermined value;

wherein the electric circuitry is configured to detect an obstruction in the airflow path based on the comparison and is configured to limit the power supplied to the heater assembly if an obstruction is detected until the obstruction has been removed.

EX54. An aerosol-generating system according to example EX53, wherein the electric circuitry is configured to perform the method of any one of examples EX1 to EX52.

EX55. An aerosol-generating system according to example EX53 or EX54, further comprising an aerosol-forming substrate.

EX56. An aerosol-generating system according to example EX55, wherein the aerosol-forming substrate is a liquid aerosol-forming substrate.

EX57. An aerosol-generating system according to example EX56, wherein the liquid aerosol-forming substrate is contained in a liquid storage portion.

EX58. An aerosol-generating system according to example EX57, wherein the liquid storage portion is defined between an inner wall and an outer wall of a housing of the aerosol-generating system.

EX59. An aerosol-generating system according to example EX58, wherein the aerosol-forming substrate is contained in an annular space defined between the inner and outer walls.

EX60. An aerosol-generating system according to example EX58 or EX59, wherein the inner wall defines an internal passage through the liquid storage portion.

EX61. An aerosol-generating system according to any one of examples EX57 to EX60, further comprising a capillary material filling the liquid storage portion.

EX62. An aerosol-generating system according to any one of examples EX53 to EX61, wherein the heater assembly comprises a wick configured to draw liquid aerosol-forming substrate towards a heater element of the heater assembly.

EX63. An aerosol-generating system according to example EX62, wherein the airflow path passes through the wick.

EX64. An aerosol-generating system according to example EX63, wherein the obstruction is in the portion of the airflow path that passes through the wick.

EX65. An aerosol-generating system according to any one of examples EX62 to EX64, wherein the wick is an air-permeable ceramic wick.

EX66. An aerosol-generating system according to any one of examples EX53 to EX65, wherein the heater assembly comprises a heating element configured to heat up when power is supplied to the heater assembly.

EX67. An aerosol-generating system according to example EX66, wherein the heater element of the heater assembly may be a resistively heatable heating element.

EX68. An aerosol-generating system according to example EX66, wherein the heater element is a susceptor element.

EX69. An aerosol-generating system according to example 68, further comprising a an inductor coil.

EX70. An aerosol-generating system according to any one of examples EX53 to EX69, comprising a first sensor downstream of the heater assembly.

EX71. An aerosol-generating system according to any one of examples EX53 to EX70, comprising a first sensor downstream of the heater assembly and a second sensor upstream of the heater assembly.

EX72. An aerosol-generating system according to example EX71, wherein the electric circuitry is configured to calculate the difference between signals from the first and second sensors as part of measuring a value associated with the airflow property.

EX73. An aerosol-generating system according to any one of examples EX53 to EX72, wherein the predetermined value is a value for the airflow property in normal use, without an obstruction present in the airflow path.

EX74. An aerosol-generating system according to any one of examples EX53 to EX73, wherein the comparison with the predetermined value comprises the electric circuitry being configured to calculate the difference between the predetermined value and the measured value.

EX75. An aerosol-generating system according to example EX74, wherein the electric circuitry is configured to detect an obstruction when the magnitude of the difference exceeds a predetermined limit.

EX76. An aerosol-generating system according to example EX75, wherein the predetermined limit corresponds to a pressure between 60 and 160 Pa.

EX77. An aerosol-generating system according to example EX76, wherein the predetermined limit corresponds to a pressure between 80 and 150 Pa.

EX78. An aerosol-generating system according to any one of examples EX53 to EX72, wherein the predetermined value is a predetermined threshold representing a value for the airflow property when the airflow path comprises obstructed.

EX79. An aerosol-generating system according to example EX78, wherein the electric circuitry is configured to directly compare the measured value with the predetermined threshold.

EX80. An aerosol-generating system according to any one of examples EX53 to EX79, wherein the electric circuitry is configured to determine the predetermined value during a threshold determining phase comprising one or more user puffs.

EX81. An aerosol-generating system according to example according to example EX80, wherein the electric circuitry is configured to measure a value associated with the property of air during the course of each user puff during the threshold determining phase.

EX82. An aerosol-generating system according to example EX81, wherein the threshold determining phase comprises more than one puff and the predetermined value is determined based on an average of the measured values from each puff during the threshold determining phase.

EX83. An aerosol-generating system according to example EX82, wherein the threshold determining phase comprises two, three or four puffs.

EX84. An aerosol-generating system according to example EX82 wherein the threshold determining phase comprises five puffs.

EX85. An aerosol-generating system according to any one of examples EX80 to EX84, wherein the electric circuitry is configured such that the threshold determining phase begins when a user first puffs on the aerosol-generating system.

EX86. An aerosol-generating system according to any one of examples EX80 to EX85, wherein the electric circuitry is configured such that the user can initiate the threshold determining phase at a later time.

EX87. An aerosol-generating system according to any one of examples EX80 to EX86, wherein the electric circuitry is configured to determine the predetermined value directly from the measured values of the airflow property during the threshold determining phase.

EX88. An aerosol-generating system according to any one of examples EX80 to EX86, wherein the predetermined value is a predetermined threshold and wherein the electric circuitry is configured to convert the measured values from the or each of the puffs of the threshold determining phase into a threshold.

EX89. An aerosol-generating system according to example EX88, wherein the conversion comprises increasing or decreasing the average of the measured value by a predetermined amount.

EX90. An aerosol-generating system according to example EX89, wherein the predetermined amount corresponds to a pressure between 60 and 160 Pa.

EX91. An aerosol-generating system according to example EX90, wherein the predetermined amount corresponds to a pressure between 80 and 150 Pa.

EX92. An aerosol-generating system according to any one of examples EX53 to EX91, wherein the aerosol-generating system comprises a cartridge and an aerosol-generating device, the cartridge being configured to be used with the device.

EX93. An aerosol-generating system according to example EX92, wherein the cartridge comprise at least a portion of the heater assembly.

EX94. An aerosol-generating system according to example EX93, wherein the cartridge comprises the heater element of the heater assembly.

EX95. An aerosol-generating system according to example EX93 or EX94, wherein the heater assembly comprises a susceptor element as a heater element and an inductor coil, and wherein the cartridge comprises the susceptor element.

EX96. An aerosol-generating system according to example EX95, wherein the cartridge further comprises the inductor coil.

EX97. An aerosol-generating system according to example EX95, wherein the aerosol-generating device comprises the inductor coil.

EX98. An aerosol-generating system according to any one of examples EX92 to EX97, wherein the aerosol-generating device comprises the power supply.

Features described in relation to one example or embodiment may also be applicable to other examples and embodiments.

Examples will now be further described with reference to the figures in which:

FIG. 2 is a schematic illustration of the cross-section of the ceramic wick of the aerosol-generating system of FIG. 1.

Figure 1:
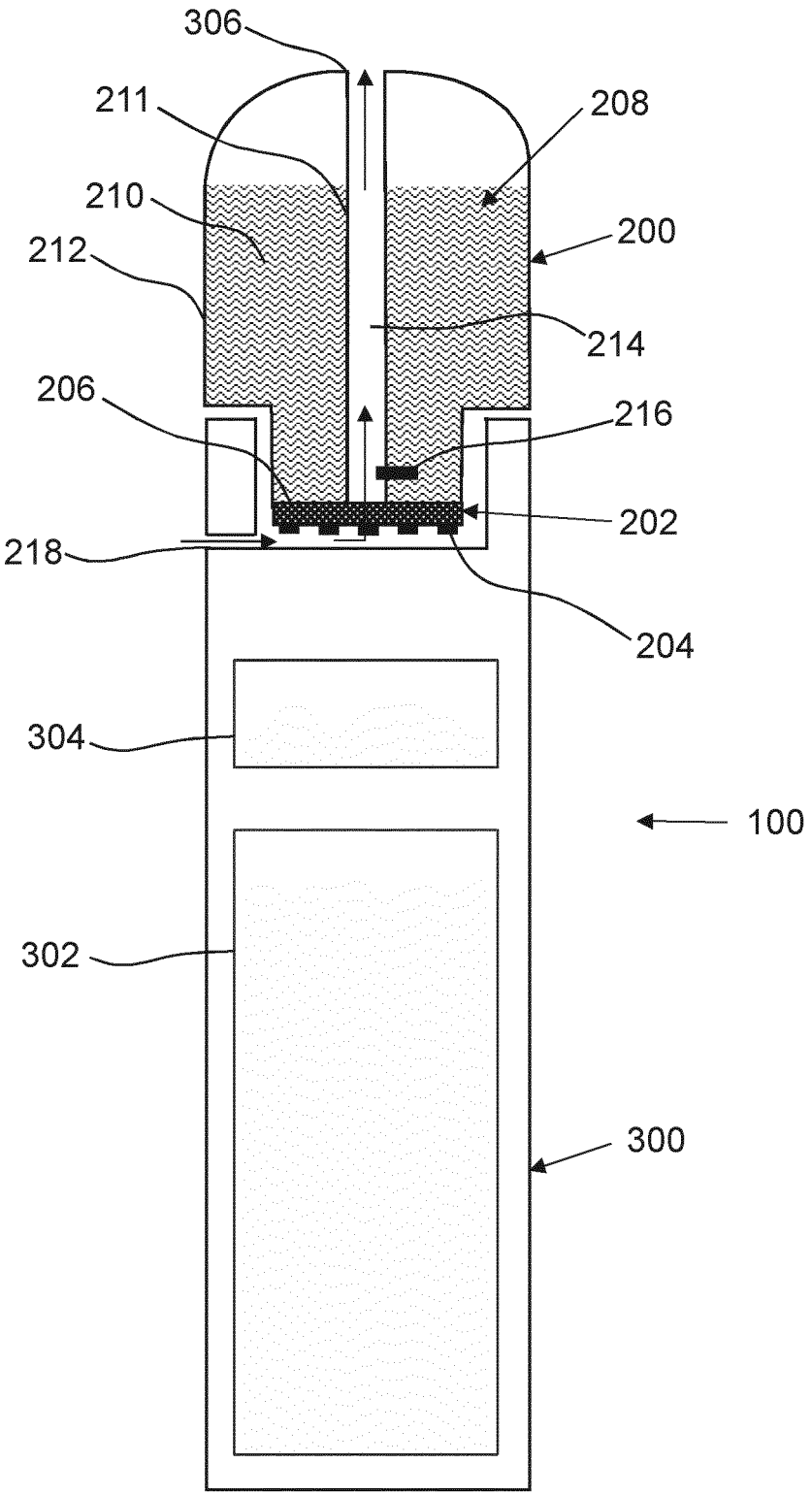
FIG. 1 is a schematic illustration of the cross-section of a first example of the aerosol-generating system according to the invention.

FIG. 1 shows a schematic illustration of a cross-section of an aerosol-generating system 100 according to a first example of the present disclosure. The system comprises a cartridge 200 and an aerosol-generating device 300. As shown in FIG. 1, a portion of the cartridge 200 is received in a cavity of the device 300. The cartridge 200 is removable from the cavity of the device 300.

The cartridge 200 comprises a heater assembly 202 comprising a resistive heater element 204 and a ceramic wick 206. The resistive heater element 204 is in the form of conductive tracks printed on the ceramic wick 206. The resistive heater element 204 is formed of a conductive material configured to heat up when a current is passed through it. The ceramic wick 206 is air permeable.

The cartridge 200 further comprises a liquid storage portion 208 containing a liquid aerosol-forming substrate 210. The liquid storage portion 208 is defined by a cartridge housing. The cartridge housing comprises an inner wall 211 and an outer wall 212 with the liquid storage portion 208 being defined between the inner and outer wall 211, 212. The liquid storage portion 208 is annular. The inner wall 211 further defines an internal passage 214 on the opposite side of the inner wall 211 to the liquid aerosol-forming substrate 210.

The heater assembly 202 is positioned at an end of the cartridge 200 such that the ceramic wick 206 of the heater assembly 202 extends across the internal passage 214. The ceramic wick 206 also extends into the end portion of the liquid storage portion 208.

The ceramic wick 206 is configured to draw liquid aerosol-forming substrate 210 from the liquid storage portion 208. This has the effect of drawing the liquid aerosol-forming substrate 210 towards the heater element 204.

The aerosol-generating device 300 comprises a power supply in the form of a rechargeable battery 302 and electric circuitry 304 comprising a microcontroller, not shown in the Figures.

Both the cartridge 200 and the aerosol-generating device 300 comprise electrical contacts, not shown in the Figures. The electrical contacts of the aerosol-generating device 300 are electrically connectable to the battery 302. The electrical contacts of the cartridge 200 are electrically connected to the heater element 204. The electrical contacts of the cartridge 200 are configured to make contact with the electrical contacts of the aerosol-generating device 300 when the cartridge 200 is received in the cavity of the device 300, as shown in FIG. 1. In this way, power from the battery 302 can be supplied to the heater element 304 such that the heater element 304 heats up. The supply of power from the battery 302 to the heater element 304 is controlled by the electric circuitry 304. In particular, the electric circuitry 304 is normally configured to supply power to the heater element 304 during a puff but will prevent that supply of power if an obstruction is detected, as will be described below.

When the cartridge 200 is received in the cavity of the aerosol-generating device 300, an airflow path is defined through the aerosol-generating system from an air inlet 218 to an air outlet 306. The air inlet 218 is defined in a housing of the aerosol-generating device. The air outlet 306 is defined in the housing of the cartridge 200. The airflow path passes from the air inlet 218 into a channel defined in the aerosol-generating device 300 and then on into the cavity. From there, the airflow path passes through the heater assembly 202. In particular, the airflow path passes between tracks of the heater element 204 and then passes through the air-permeable ceramic wick 206. After the heater assembly 202, the airflow path passes through the internal passage 214 of the cartridge 200 before ending at the air outlet 306. The portion of the cartridge comprising the air outlet 306 may be referred to as a mouthpiece.

The path of air through the airflow path is demonstrated by the arrows shown in FIG. 1. This is the path that air will flow through the aerosol-generating system 100 when a user of the system draws on the mouthpiece of the cartridge 200.

The cartridge 200 further comprises a first sensor 216, a portion of which is positioned in the airflow path downstream of the heater assembly 202. The first sensor 216 is a pressure sensor and is suitable for measuring the pressure of air in that portion of the airflow path. The distance between the first sensor 216 and the heater assembly is less than 2 centimetres. The first sensor 216 is a Low Voltage Barometric Pressure Sensor (MS5637-02BA03) available from Digi-key electronics (https://www.digikey.com/).

When a user is puffing on the aerosol-generating system, the electric circuitry 304 is configured to supply power to the heater element 204 such that the heater element 204 heats up. The heater element 204 is in contact with the ceramic wick 206 and so heat from the heater element 204 is conducted to the ceramic wick 206 and then to aerosol-forming substrate contained in the ceramic wick 206. This aerosol-forming substrate will then be vaporized and drawn into the air passing through the ceramic wick 206 as a user draws on the mouthpiece. Vaporized substrate cools and condenses to form an aerosol in the internal passage 214 which can then be inhaled by the user. The ceramic wick 206 will continuously draw fresh aerosol-forming substrate from the liquid storage portion providing a continuous supply of the substrate to be vaporised by the heater assembly.

The aerosol-forming substrate in the ceramic wick 206 will not always be completely vaporized. A small amount of residue of aerosol-forming substrate may remain in the heater assembly 202 after a puff. Over time this residue agglomerates to create an obstruction in the airflow path. In particular, the residue agglomerates in the ceramic wick 206 and in the heater element 204 to create an obstruction in the portion of the airflow path passing through the heater assembly 202.

Figure 2A:
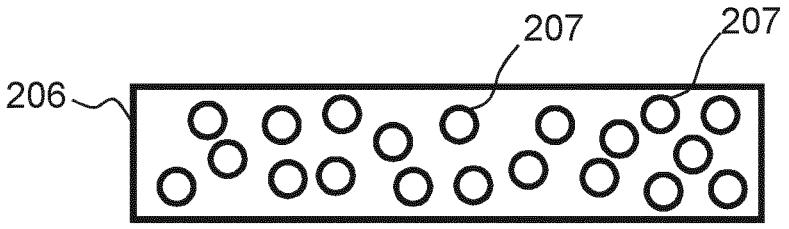
FIG. 2*a* shows an unobstructed wick and FIG. 2*b* shows the same wick with an obstruction.

FIG. 2 is a schematic illustration of the cross-section of the ceramic wick 206 of the aerosol-generating system 100 shown on its own, separately from the rest of the system. FIG. 2*a* shows the ceramic wick 206 without any residue agglomeration. The ceramic wick 206 comprise a plurality of pores 207. Air can pass through the pores 207, hence why the ceramic wick 206 is air permeable. Furthermore, aerosol-forming substrate can be transported through the pores. The size of the pores has been exaggerated in FIG. 2.

Figure 2B:
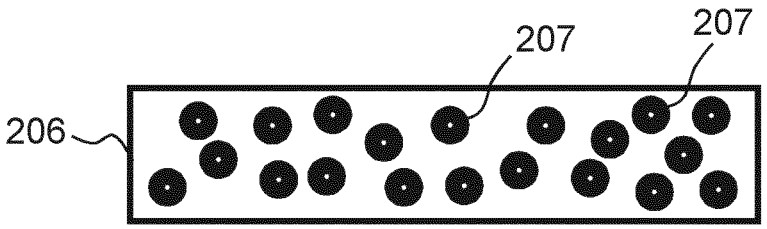

FIG. 2*b* shows the ceramic wick 206 with residue agglomeration in the pores 207. As shown in FIG. 2*b*, this agglomeration has essentially caused a restriction in each of the pores 207, reducing the ability of air to pass through the ceramic wick 206. In other words, the agglomeration of aerosol-forming substrate residue in ceramic wick 206 has caused an obstruction in the airflow path passing through the aerosol-forming substrate.

Such an obstruction in the airflow path of the aerosol-generating system 100 is a problem. Overheating or burning of the residue may contribute a burnt flavour to the aerosol generated by the aerosol-generating system 100. Furthermore, the obstructed ceramic wick 206 will increase the resistance to draw of the aerosol-generating system 100 which is undesirable. As such, the electric circuitry of the aerosol-generating system 100 is configured to detect the obstruction caused by the agglomerated aerosol-forming substrate residue based on pressure measurements made by the first pressure sensor 216. This is possible because the presence, or lack thereof, of an obstruction in the airflow path will affect the pressure in the airflow path during use. This difference is represented in the FIG. 3.

Figure 3:
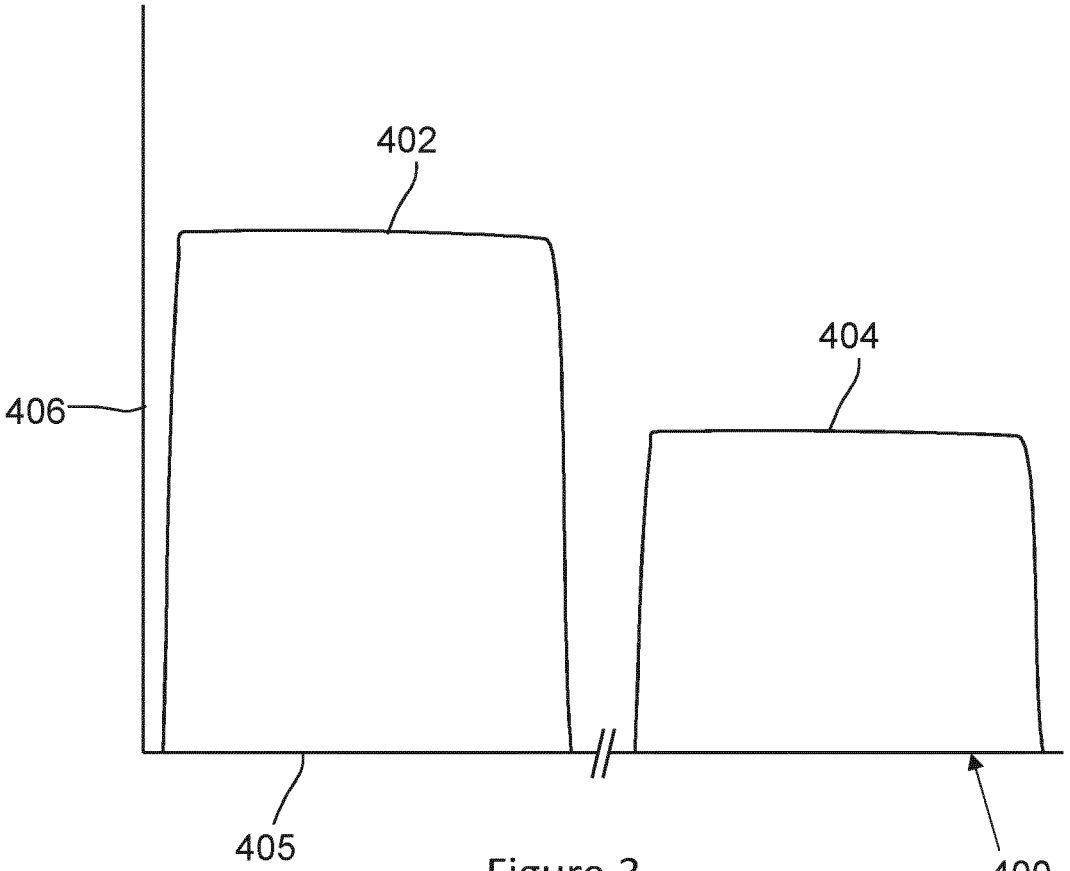
FIG. 3 is a graph showing a representation of the pressure profile of a puff as measured downstream of the wick when the wick is unobstructed and when the wick is obstructed.

FIG. 3 shows a graph 400 that represents pressure downstream of the heater assembly 202, as measured by the first pressure sensor 216, both with and without an obstruction. The x axis 405 of the graph 400 represents time and the y axis 406 represents pressure. The graph shows a first puff 402 and a second puff 404. The first puff 402 represents an early puff of the aerosol-generating system 100, before aerosol-forming substrate residue has had a chance to agglomerate substantially. The second puff 404 represents a puff at a later time, after there has been substantial agglomeration aerosol-forming substrate residue in the heater assembly 202. The x-axis is truncated to show these temporally separated puffs as being sequential.

At the start of the first puff 402, the pressure almost instantaneously builds up to a constant pressure that is maintained throughout the duration of the puff. At the end of the puff, the pressure almost instantaneously falls to zero.

The second puff 404 follows a similar pattern to the first puff 402. But the constant pressure during the second puff 404 is lower than that of the first puff 402. This is because, during the second puff 404, the obstruction caused by the agglomeration of aerosol-forming substrate residue in the ceramic wick 206 creates a restriction in the airflow path. Through a restriction, flow speed increases while pressure decreases. The first sensor 216 is sufficiently close to the heater assembly 202 for this pressure decrease to be pronounced.

Figure 4:
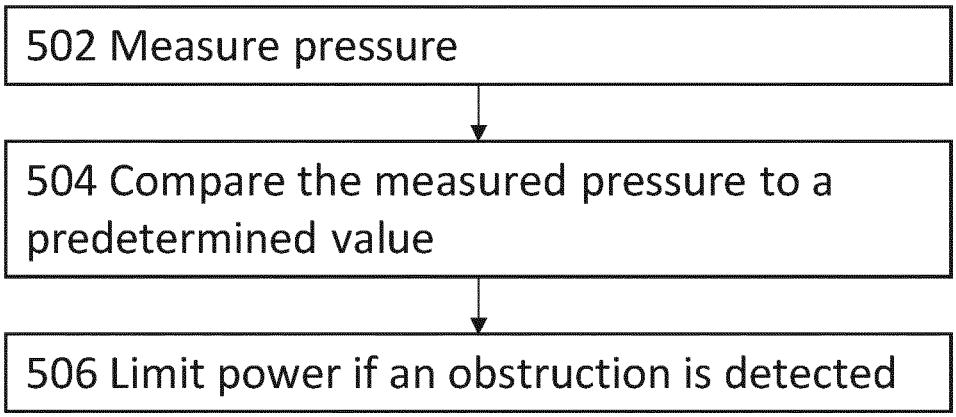
FIG. 4 is a flow diagram of a method of detecting an obstruction.

FIG. 4 shows a method of detecting an obstruction in an airflow path. Step 502 of the method comprises measuring pressure using the first sensor 216. This comprises the electric circuitry 304 receiving signals from the first sensor 216 and from those signals determining the pressure.

At step 504, the measured pressure value is compared to a predetermined value stored in a memory of the electric circuitry 304. In this case, the predetermined value represents the pressure value when no obstruction is present in the airflow path. If the difference between the predetermined value and the measured value is 100 Pa or more then an obstruction is detected. This is because the obstruction causes a pressure drop downstream of the obstruction, If an obstruction is detected, the method moves on to step 506. At step 506, the electric circuitry 304 limits the supply of power from the power supply to the heater assembly 202. This prevents use of the aerosol-generating system 100. Power is limited until the obstruction has been removed. This may be achieved either by the user replacing the cartridge 200 with a fresh cartridge, or by cleaning the cartridge 200. Cleaning the cartridge can either comprise removing the cartridge 200 and physically cleaning the heater assembly 202 to remove the agglomerated residue or by cleaning the cartridge while it is received in the aerosol-generating device wherein a heating procedure is initiated which causes pyrolysis of the residue.

Figure 5:
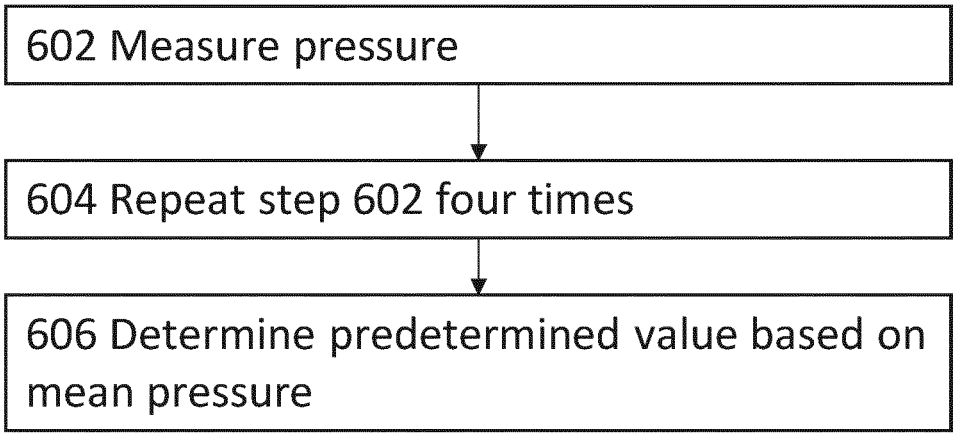
FIG. 5 is a flow diagram of a method of determining a predetermined value for the method of FIG. 4.

The predetermined value is determined during a threshold determining phase. The steps of the threshold determining phase are shown in FIG. 5.

At step 602, pressure is measured during the course of the first user puff of aerosol-generating. This comprises the electric circuitry 304 receiving signals from the first sensor 316 and from those signals determining the pressure. The measured pressure is stored in a memory of the electric circuitry 304.

At step 604, step 602 is repeated four times for successive puffs. Thus, five pressure measurements stored in the memory of the electric circuitry 304.

At step 606, the electric circuitry is configured to determine a mean average of the five pressure measurements. This mean average pressure value represents a pressure value when no obstruction is present in the airflow path. The predetermined value is equal to the mean average.

The threshold determining phase described above begins on the first use of the aerosol-generating system 100. The aerosol-generating system 100 further comprises a user interface (not shown in the Figures) which is connected to the electric circuitry 304. A user of the device can initiate the threshold determining phase at a time later than the initial use by inputting on the user interface, for example by pressing a button on the user interface. This results in the method of FIG. 5 being repeated and a new threshold value being determined. This is useful, for example, if there is a new user of the aerosol-generating system 100 having a different puff behaviour.

While the method of FIG. 5 is being carried out, the method of FIG. 4 is not. In other words, the aerosol-generating system 100 will not determine the presence of an obstruction while in the threshold determining phase.

The predetermined value described in relation to FIGS. 4 and 5 is a value that represents the pressure value when no obstruction is present in the airflow path. In another example, the predetermined value is a predetermined threshold. That is, the predetermined value is a value that represents the pressure when an obstruction is present. In this case, the comparison of step 504 comprises comparing the predetermined threshold with the measured value to see if the measured value is equal to or less than the predetermined threshold. If the measured value is equal to or less than the predetermined threshold, an obstruction is detected.

Figure 6:
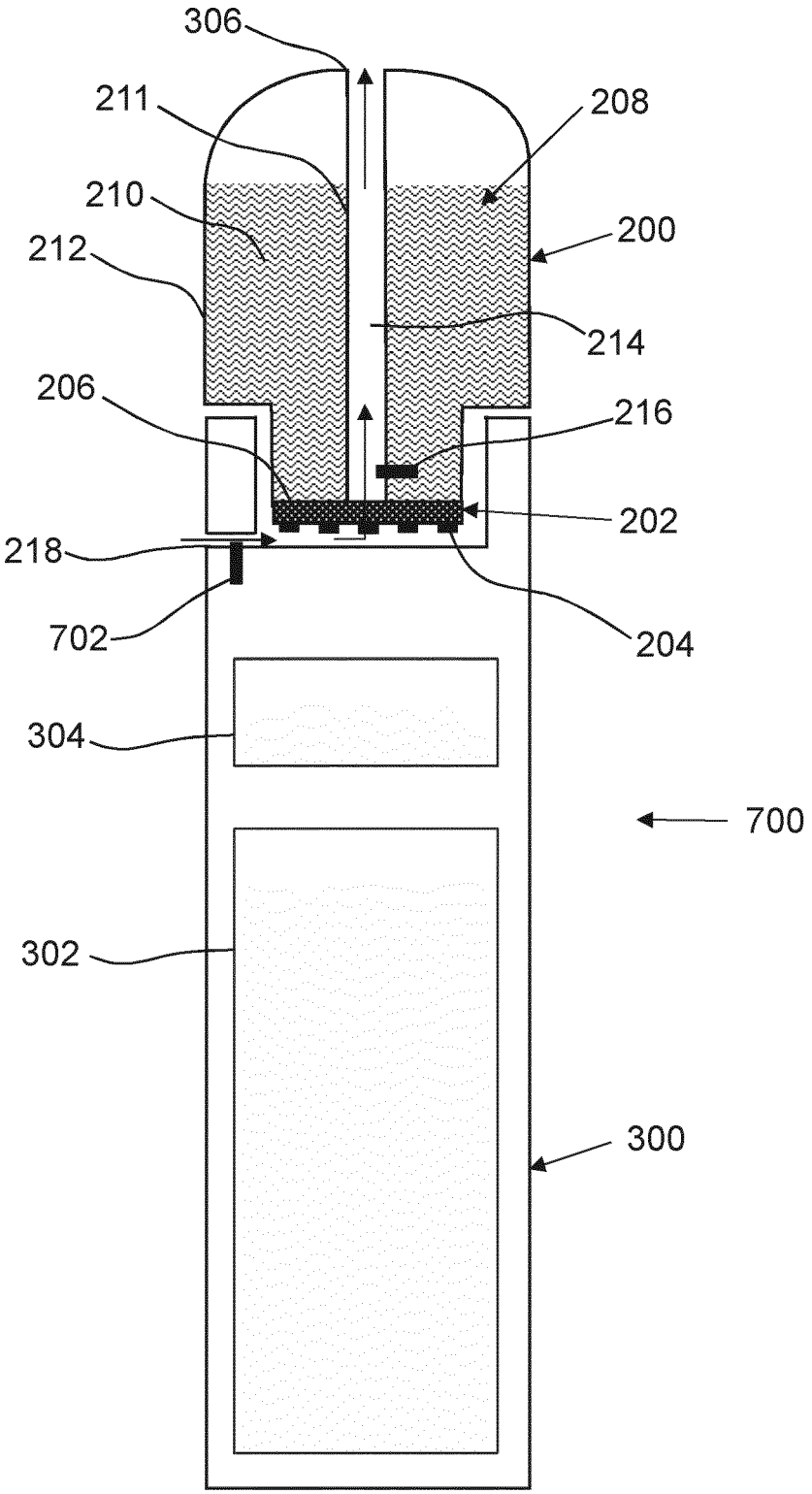
FIG. 6 is a schematic illustration of the cross-section of a second example of the aerosol-generating system according to the invention.

A predetermined threshold representative of the pressure value when an obstruction is present is determined according to a similar method to the method shown in FIG. 6. However, the mean average pressure determined at step 606 of the method is representative of the pressure without an obstruction rather than with an obstruction. Therefore, the method comprises the additional step of converting the mean average pressure into a threshold pressure value. This comprises subtracting a predetermined amount from the mean average pressure. In this example, the predetermined amount is 100 Pa.

The aerosol-generating system 100 has been described in relation to a system comprising a single sensor 216. FIG. 6 shows a second example of an aerosol-generating system 700 which additionally comprises a second pressure sensor 702 upstream of the heater assembly 202. Otherwise, the second example of FIG. 6 has the same features as the first of FIG. 1 and like features are numbered accordingly.

The aerosol-generating system 700, comprising both a first pressure sensor 216 and a second pressure sensor 702, is configured to determine a differential pressure measurement in both the obstruction detection method and during the threshold determining phase. The second sensor 702 is a Low Voltage Barometric Pressure Sensor (MS5637-02BA03) available from Digi-key electronics (https://www.digikey.com/).

The electric circuitry 304 is configured to calculate the differential pressure measurement by subtracting the pressure measured by the first pressure sensor 216 from the pressure measured by the second pressure sensor 702. As above, the pressure downstream of the heater assembly 202, as measured by the first pressure sensor 216, will be lower than the pressure upstream of the heater assembly 202, as measured by the second pressure sensor 702. Subtracting the measured pressures leaves a value representing the pressure drop caused by the heater assembly 202 and, importantly any obstructions in the heater assembly 202.

Figure 7:
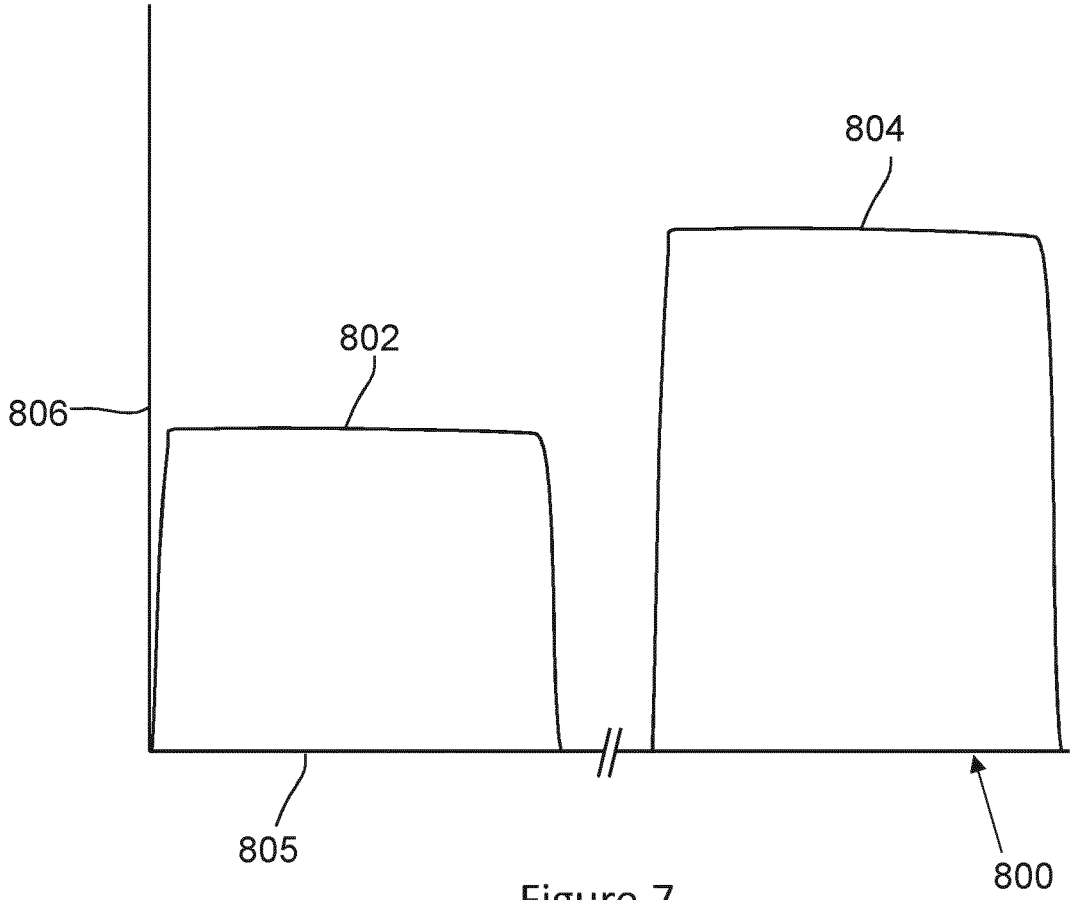
FIG. 7 is a graph showing a representation of the differential pressure profile of a puff as measured by a first sensor downstream of a heater assembly and a second sensor upstream of the heater assembly.

FIG. 7 shows a graph 800 that represents differential pressure both with and without an obstruction in the heater assembly 202. Similarly to FIG. 3, the x axis 805 of the graph 800 represents time. However, the y axis 806 represents differential pressure rather than simply pressure. The graphs shows a first puff 802 and a second puff 804. The first puff 802 represents an early puff of the aerosol-generating system 700, before aerosol-forming substrate residue has had a chance to agglomerate substantially. The second puff 804 represents a puff at a much later time, after there has been substantial agglomeration aerosol-forming substrate residue in the heater assembly 202. The x-axis is truncated to show these temporally separated puffs as being sequential.

At the start of the first puff 802, the pressure almost instantaneously builds up to a constant differential pressure that is maintained throughout the duration of the puff. At the end of the puff, the pressure almost instantaneously falls to zero. The constant differential pressure during the main part of the puff is non-zero. This is because, even though there is no residue in the heater assembly in the first puff, the heater assembly 202 itself still represents a restriction in the airflow path. So, the constant differential pressure during the main part of the puff represents the pressure drop caused by the presence of the clean heater assembly 202.

The second puff 804 follows a similar pattern to the first puff 802. But the constant differential pressure during the main part of the second puff 804 is greater than that of the first puff 802. This is because, during the second puff 404, the obstruction caused by the agglomeration of aerosol-forming substrate residue in the ceramic wick 206 creates a restriction in the airflow path. This increases the pressure drop across the heater assembly 202 and so increases the differential pressure measured during the main part of the second puff 804.

The aerosol-generating system 700 of the second example operates similarly to the aerosol-generating system 100 of the first example. However, any step in the method of the aerosol-generating system 100 of the first example that comprises measuring pressure instead comprises measuring differential pressure in the aerosol-generating system 700 of the second example. In the aerosol-generating system 700, the predetermined value of step 504 represents a threshold value for the differential pressure. Differential pressure measurements equal to, or greater than, this threshold value indicate that the airflow path has been obstructed by aerosol-forming substrate residue which has agglomerated in the heater assembly 202. Furthermore, the threshold differential pressure value is calculating by determining a mean average of five differential pressure measurements in steps 602 to 606.

Figure 8:
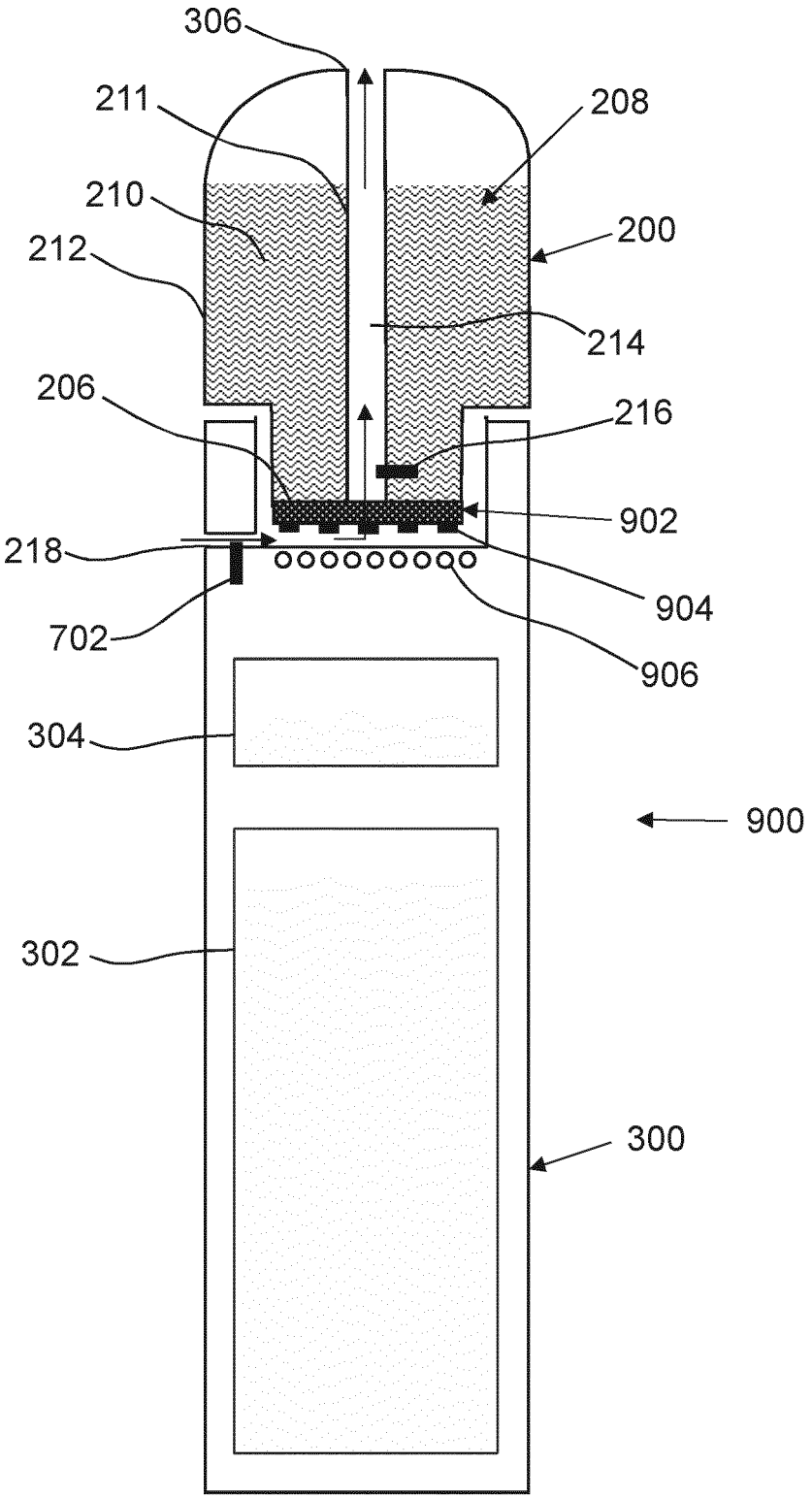
FIG. 8 is a schematic illustration of the cross-section of a third example of the aerosol-generating system according to the invention.

FIG. 8 shows a third example of an aerosol-generating system 900. The aerosol-generating system 900 has a different heater assembly to the aerosol-generating system 700 of the second example. Otherwise, the aerosol-generating systems 700 and 900 are identical and like features are numbered accordingly.

The aerosol-generating system 900 of the third assembly comprises an inductive heater assembly 902. The inductive heater assembly 902 comprises a susceptor element 904 instead of a resistive heater element. The susceptor element 904 is again provided as tracks printed on the ceramic wick 206.

The heater assembly 902 further comprises an flat spiral inductor coil 906. The flat spiral inductor coil 906 part of the aerosol-generating device in the third example. So, in this example, only a portion of the heater assembly 902 is contained in the cartridge.

The inductor coil 906 is positioned close to the base of the cavity such that when the cartridge 200 is received in the cavity, the susceptor element 904 is close to the inductor coil 906 to promote efficient heating. The electric circuitry 304 and battery 302 are configured to supply a high frequency alternating current to the inductor coil during use of the aerosol-generating system 900. This results in heating of the susceptor element 904 and so heating of the aerosol-forming substrate.

The aerosol-generating systems 700 and 900 can be used to detect an obstruction in the airflow path and to determine a predetermined value for the obstruction detection method in the same way as described in relation to the aerosol-generating system 100 of the first example.

The invention claimed is:

1. A method of detecting the presence of an obstruction in an airflow path of an aerosol-generating system, the system comprising a heater assembly for heating an aerosol-forming substrate, a power supply, an airflow path defined between an air inlet and an air outlet and passing through the heater assembly, and at least one sensor for sensing an airflow property of air in the airflow path; the method comprising:

measuring a plurality of values associated with the airflow property during the course of a plurality of user puffs based on signals from the at least one sensor;

determining an average of values from the plurality of values;

comparing this average of values to a predetermined value;

detecting an obstruction in the airflow path based on the comparison;

and limiting the power supplied to the heater assembly, or providing an indication, if an obstruction is detected.

2. The method according to claim 1, wherein the obstruction is an obstruction in a portion of the airflow path passing through the heater assembly.

3. The method according to claim 1, further comprising, after an obstruction has been detected, the step of limiting the power supplied to the heater assembly until the obstruction has been removed.

4. The method according to claim 1, wherein the airflow property is pressure and the at least one sensor is a pressure sensor.

5. The method according to claim 1, wherein the system comprises at least a first sensor downstream of the heater assembly and a second sensor upstream of the heater assembly.

6. The method according to claim 5, wherein the step of measuring the plurality of values associated with the airflow property comprises calculating the difference between a signal from the first sensor and a signal from the second sensor.

7. The method according to claim 1, further comprising the step of determining the predetermined value during a threshold determining phase comprising one or more user puffs.

8. The method according to claim 7, wherein the first puff of the threshold determining phase is triggered when a user first puffs on the aerosol-generating system.

9. The method according to claim 7, wherein the step of determining the predetermined value comprises:

measuring a value associated with the property of air during the course of each user puff during the threshold determining phase; and determining the predetermined value based on the one or more measurements.

10. The method according to claim 9, wherein the threshold determining phase comprises more than one puff and the predetermined value is determined based on an average of the measured values from each puff of the threshold determining phase.

11. The method according to claim 1, further comprising the step of removing the obstruction.

12. The method according to claim 11, wherein the step of removing the obstruction comprises replacing the heater assembly or cleaning the heater assembly while the heater assembly remains connected to the aerosol-generating device.

13. An aerosol-generating system comprising:

a heater assembly for heating an aerosol-forming substrate;

a power supply;

an airflow path defined between an air inlet and an air outlet, the airflow path passing through the heater assembly;

at least one sensor for sensing an airflow property of air in the airflow path; and electric circuitry comprising a memory and connected to the heater assembly and to the power supply, the electric circuitry being configured to measure a plurality of values associated with the airflow property during the course of a plurality of user puffs based on signals from the at least one sensor, determine an average of values from the plurality of values, and to compare this average of values with a predetermined value;

wherein the electric circuitry is configured to detect an obstruction in the airflow path based on the comparison and is configured to limit the power supplied to the heater assembly if an obstruction is detected until the obstruction has been removed.

14. The aerosol-generating system according to claim 13, wherein the heater assembly comprises an air-permeable ceramic wick and wherein the airflow path passes through the wick.

15. The aerosol-generating system according to claim 13, wherein the system comprises a cartridge and an aerosol-generating device, the cartridge being configured to be used with the device, wherein the cartridge comprises at least a portion of the heater assembly and wherein the device comprises power supply and the electric circuitry.

* * * * *